US008087737B2

(12) United States Patent
Shoenfeld

(10) Patent No.: US 8,087,737 B2
(45) Date of Patent: Jan. 3, 2012

(54) ERGONOMIC FILMLESS RADIOLOGY WORK STATION WITH KEYBOARD SANITIZER

(75) Inventor: Norman A. Shoenfeld, Livingston, NJ (US)

(73) Assignee: S&S X-Ray Products, Inc, Pen Argyl, PA (US)

( * ) Notice: Subject to any disclaimer, the term of this patent is extended or adjusted under 35 U.S.C. 154(b) by 277 days.

(21) Appl. No.: 12/622,503

(22) Filed: Nov. 20, 2009

(65) Prior Publication Data

US 2011/0120351 A1 May 26, 2011

(51) Int. Cl.
*A47B 81/00* (2006.01)

(52) U.S. Cl. ..... 312/223.3; 312/208.1; 108/50.02; 108/96; 108/147.19; 422/186.3; 422/24

(58) Field of Classification Search ..... 312/223.3, 312/208.1, 194–196; 108/50.02, 50.01, 92, 108/96, 147, 147.19; 422/186.3, 24
See application file for complete search history.

(56) References Cited

U.S. PATENT DOCUMENTS 5,339,750 A * 8/1994 Smies ..... 108/147
5,588,376 A * 12/1996 Seidl et al. ..... 108/106
5,845,587 A * 12/1998 Ditonto ..... 108/50.01
6,278,122 B1 * 8/2001 Gagnon ..... 250/455.11
6,298,794 B1 10/2001 Brown et al.
6,458,331 B1 * 10/2002 Roberts ..... 422/186.3
6,720,950 B2 * 4/2004 Cheng ..... 345/163
6,824,230 B2 * 11/2004 Probst ..... 312/223.3
7,322,653 B2 1/2008 Dragusin
7,692,159 B2 * 4/2010 Lane et al. ..... 250/455.11
2004/0140742 A1 * 7/2004 Liu ..... 312/291
2008/0260601 A1 * 10/2008 Lyon ..... 422/186.3
2008/0289545 A1 * 11/2008 Picchio ..... 108/106

* cited by examiner

*Primary Examiner* — Janet M Wilkens
*Assistant Examiner* — Daniel Rohrhoff
(74) *Attorney, Agent, or Firm* — Bernhard P. Molldrem, Jr.

(57) ABSTRACT

An ergonomic radiology work station has front and back tables or work platforms that can be raised or lowered electrically to adjust for optimum posture and comfort of the user. Video monitors on the rear platform displays medical images. Interface equipment, e.g., keyboard and mouse, are situated on the front work platform. A pull-out sanitizer hood irradiates the keyboard and other interface devices with ultraviolet radiation after a radiology work session. An interlock arrangement ensures that the work platforms cannot be moved up or down when the hood is pulled out, and ensures that UV lamps in the hood are disabled when the hood is pushed back in to its home or withdrawn position. The hood with slide(s) and interlock(s) may be provided as a kit to retrofit an existing work station.

18 Claims, 2 Drawing Sheets

ERGONOMIC FILMLESS RADIOLOGY WORK STATION WITH KEYBOARD SANITIZER

BACKGROUND OF THE INVENTION

This invention relates workstations for daily use by radiology professionals in the interpretation of digital radiological images. The invention is also directed to workstations which provide adjustable support for the platform for the video monitors on which the images are presented, and also provide adjustable support for the keyboard, mouse, trackball, or other manipulated human-computer interface control features that are used by the radiologist for calling up and scanning the images. The invention is more particularly concerned with ergonomic radiology workstations of this type which include a feature for sanitizing the keyboard and/or other interface devices between work sessions.

As a general matter, there is no "one-size-fits-all" solution for radiology workstations. Users need to be able to adjust the position of the monitors and of the keyboard (and other interface devices) for the work session, to achieve optimal posture and to avoid fatigue. To achieve optical ergonomics, the conditions of the radiology reading room, ambient lighting, and ergonomic set-up of the keyboard, monitors and seating, must all be taken into account for each user. The height of the monitors relative to the user can be adjusted to reduce the requirement for head and body movement in reading the radiological images, and the height of the table or platform of the monitor should be adjusted relative to the user's seating to optimize comfort and reduce arm and upper body fatigue. For these reasons, a number of workstations have been proposed with a rear platform on which the video monitor or monitors are positioned, and a front platform on which the keyboard and mouse or trackball are positioned. Electric gearmotors or similar devices are installed for adjusting the height of the front and rear platforms for the user's comfort and to reduce fatigue factors. The workstation has a base that rests on the floor, and a pedestal or pedestals, which include a height adjustment feature, on which the front and rear work platforms are supported. In some work stations, there can be separate independent vertical supports for the front work platform and the rear work platform. In other work stations, the there can be a main vertical support pedestal for the rear table or platform, and an arm or arms that support the front work platform from the main pedestal, and allow for controlled motorized height adjustment of the front work table or platform.

These workstations are frequently used by a number of different radiology professionals during the day, with each having his or her own height requirement for both the monitor platform and the keyboard platform. The workstations have up/down controls for both the rear and front platforms, so that these height adjustments can be made easily for each radiologist at the commencement of the work session. In some work stations, the settings can be stored or programmed, and then the necessary adjustments made automatically for each individual radiology professional.

Because each radiology work station is used by a number of different people, there is a need to disinfect or sanitize the parts of the work station that are touched by the hands, namely, the human-machine interface devices such as the keyboard and mouse. It would be desirable to carry out some sort of sanitization at the end of each radiology work session, but to date no simple provision has been included in any radiology work station that could effectively sanitize the keyboard and mouse or trackball.

A separate, stand-alone keyboard and mouse sterilizing device has been described in U.S. Pat. No. 6,278,122, for a general-use computer work station. A UV sterilization feature is provided to radiate a keyboard and mouse. The keyboard and mouse are mounted on a sliding platform, and an ultraviolet lamp is turned on when the platform is slid into an enclosure. The device is practical only with a non-adjustable workstation, and would be difficult to incorporate into an ergonomic work station of the type to which the present invention is directed.

OBJECTS AND SUMMARY OF THE INVENTION

Accordingly, it is an object of the present invention to provide an ergonomic radiology work station arrangement that avoids the drawbacks of the prior art, and permits safe and effective keyboard sterilization after the completion of a work session.

It is another object to provide a radiology work station with a keyboard sterilization feature that can be used when needed and will not interfere with the normal adjustment of the height of front or rear portions of the work station.

It is still another object to provide a keyboard sterilization feature for a radiology work station, in which a sterilizer hood can be pulled out for use and remain in a withdrawn position during a normal radiology work session.

In accordance with an aspect of this invention, an ergonomic filmless radiology work station is provided for a radiologist to study medical images that have been captured in digital form and displayed on one or more monitors. The work station is formed of a base adapted to rest upon the floor of the work room or work center. At least one pedestal or pedestal arrangement extends vertically upward from base, and supports an front work platform or table top, and a rear work platform or table top. The front work platform is adjustably supported from the pedestal arrangement so it can be adjusted up or down to suit the radiologist or other user. The front work platform has a central area on its upper surface thereof adapted for placement of one or more interface control devices to be manipulated by the radiologist, namely, a keyboard and a mouse or trackball device. The rear work platform is situated rearward or distally of the front work platform and is elevated in respect to the front work platform. The rear work platform is adjustably supported from the pedestal arrangement, with rear work platform being adapted to support one or more video monitors which display the medical images to be studied by the radiologist. A motorized height adjustment mechanism is operatively coupled with the front work platform and the rear work platform to allow the radiologist to control and position the two work platforms respectively at desired heights above the base. A control panel, i.e., up and down switches, are provided for the radiologist and are coupled to motorized height adjustment mechanism. These can be actuated by the radiologist, so that the motorized height adjustment mechanism moves each of the front and rear work platforms upward and downward to the correct height for optimal comfort and efficiency.

A keyboard sanitizer device is in the form of a hood mounted at an underside of the rear work platform. A drawer slide or slides mounted on the rear work platform support an upper support plate, which is thus adapted to be pulled forward to an extended position and pushed in to a retracted position beneath the rear work platform. At least one UV generator lamp, e.g., a pair of UV fluorescent tubes, is positioned on said upper support plate; and a shield or curtain extends circumferentially about the support plate and depends downward from it. This curtain contains the UV radiation so that it illuminates the keyboard and mouse, but restrains stray radiation. When the keyboard sanitizer device is pulled out it is positioned over the central area, and the one UV lamp is energized, the device irradiates the central area with sanitizing UV radiation.

An electrical interlock mechanism is operatively coupled to the keyboard sanitizer device and to said motorized height adjustment mechanism. When the keyboard sanitizer device is pulled out to its extended position, the interlock mechanism disables the motorized height adjustment mechanism so that the height of the front and rear work platforms cannot be changed while the hood is pulled out. When the hood or keyboard sanitizer device is pushed in to its retracted or home position, the interlock mechanism disables the keyboard sanitizer device so that the UV generator lamp or lamps are prevented from generating UV radiation.

The work station may be of the type in which the pedestal includes left and right support posts supporting the rear work platform and left and right support posts supporting the front work platform, with the motorized height adjustment mechanism having motor drives associated each of the support posts. Of course, other arrangements are possible for adjusting the vertical positions of the front and rear work platforms relative to one another, and relative to the base.

The curtain that surrounds the keyboard sanitizer device can be formed with rigid shades disposed at least on front, left and right sides, or may incorporate a fabric curtain disposed at least on a front side of said upper support platform of the hood. The curtain may be composed of both rigid slats or shades and also fabric portions. The curtain can preferably be in the form of fabric drapes opaque to UV wavelengths.

The UV generator lamp can includes a UV fluorescent tube, or a pair of such tube. Preferably, the pair of UV fluorescent tubes are twenty-one to twenty-seven inch tubes and are disposed transversely on said upper support platform. UV-emitting LEDs may be employed for this purpose.

In one favorable embodiment, the electrical interlock mechanism can include a presence switch disposed at the back or distal side of the keyboard sanitizer hood. This can be a mechanical, magnetic, or optical presence switch. The presence switch provides an indication of one sense (e.g., on or closed) when the hood is disposed in its retracted position, and then provide an indication of an opposite sense (e.g., off or open) when the hood is pulled out to its extended position.

In other possible embodiments, the interlock mechanism may be associated with a mechanical latch that is operator actuated for pulling out the hood. Also, in some embodiments, the interlock may be software-implemented.

An auxiliary device may be used for sanitizing the monitors, where a touch screen video monitor is employed.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
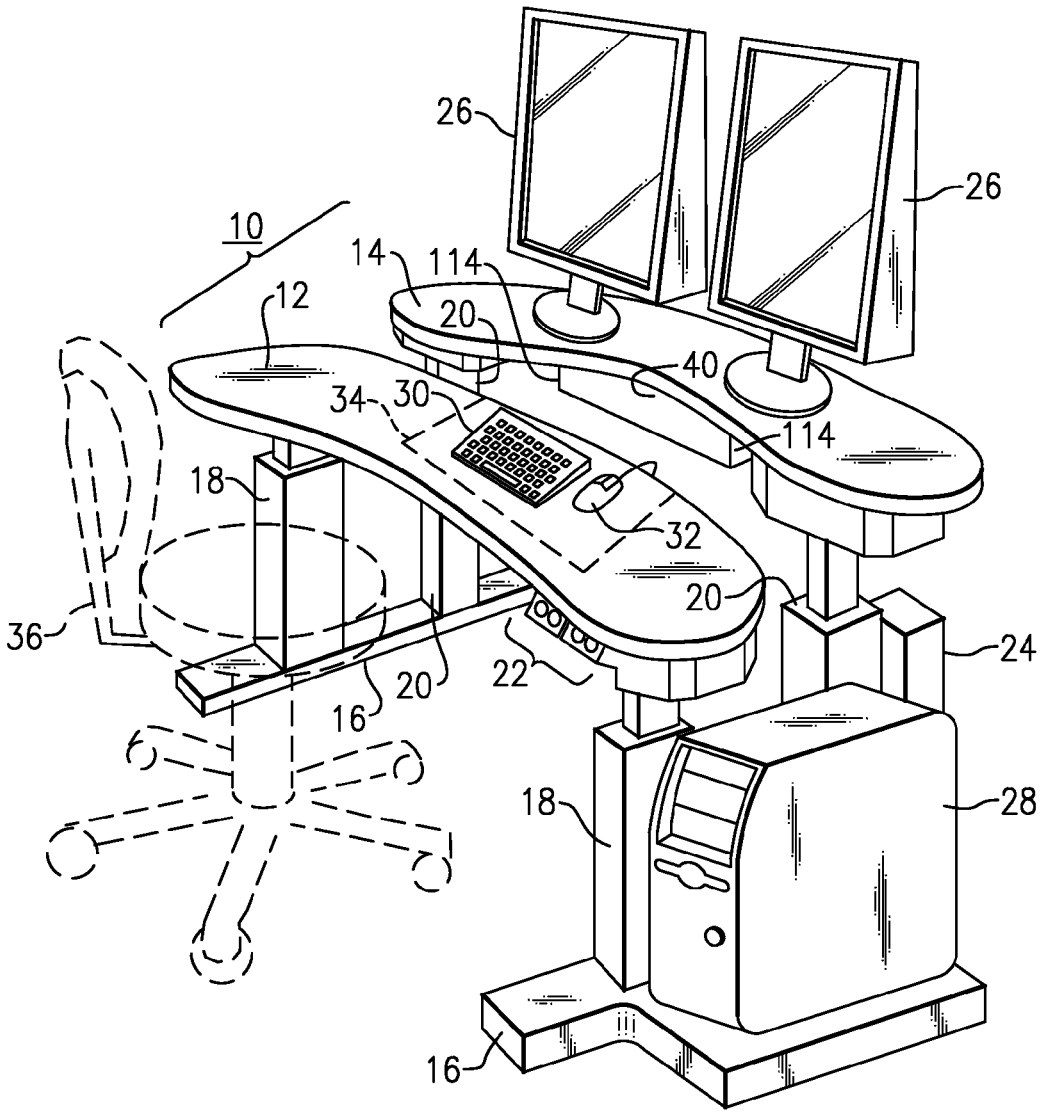
FIG. 1 is a perspective view of an ergonomic radiology work station incorporating a keyboard sanitizing hood device according to one preferred embodiment of this invention.
Figure 2:
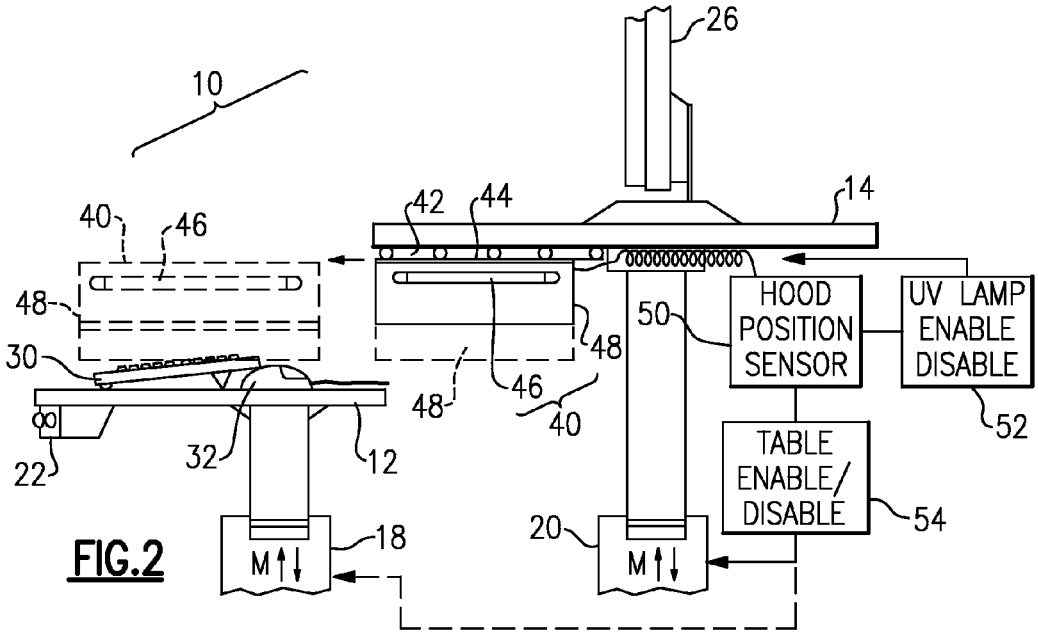
FIG. 2 is a schematic side view of this embodiment.

With reference to the Drawing, and initially to FIGS. 1 and 2, an ergonomic radiology work table or work station 10 has a front or proximal work table top or platform 12 and a rear or distal work table top or platform 14, each of which can be adjustably positioned vertically for optimal posture and comfort for the user, i.e., for the radiologist viewing and studying medical images. The support structure for the front and rear platforms includes a base 16 that rests on the floor of the radiology study room, with motorized pedestals or support posts 18 for the left and right sides of the front platform 12 and motorized pedestals or support posts 20 for the left and right sides of the rear work platform 14. In this embodiment, for each of the motorized pedestals 18, 20 there is a lower portion containing a gear motor or similar device, and an upper post portion that slides in the lower portion and on which the respective support platform is mounted. Of course, many other arrangements of adjustable-height work stations are available.

Also shown in this embodiment are a control panel 22 mounted on the front of the work platform 12, at the underside near the front edge. This panel 22 has four push-button switches to permit the user to raise and lower the front and rear work platforms 12, 14, respectively. These are connected by cables (not shown) to an electrical control box 24 shown here as positioned at the rear of one of the support pedestals 20.

From one to four video monitors may be supported on the rear work platform 14, and in this illustrated embodiment there are two flat panel monitors 26. These are coupled to a work station computer 28 which is here shown as supported on a portion of the base 16 at one end of the work station 10. The computer 28 supplies digital, i.e., filmless, medical images to the monitors 26 where they are presented to the radiologist as video images.

An operator's keyboard 30, as well as a computer mouse 32 or other human-computer interface device, are positioned in a central area 34 (shown in dash lines) of the upper surface of the front work table top or platform 12. A chair 36 is shown here in broken or ghost lines to indicate the position of the radiologist when seated at the front or proximal side of the work station 10.

An ultraviolet keyboard sanitizing hood device 40 is shown here, in the form of a slide-out hood or downward-facing compartment, which is positioned beneath the under surface of the rear table top 14, centered near the front edge thereof.

The hood or device 40 has a slide or pair of slides, formed of sliding parts 42 that are mounted onto the sides of an upper support plate 44, and fixed parts 43 that are supported on vertical members 114. These members 114 are mounted onto the underside of the table top 14, near the front or proximal edge. The members 114 are positioned at left and right sides of the hood 40. The upper support plate 44 is mounted on the slide or slides 42 43, so that the support plate can be pulled forward out from under the table top 14 and pushed back to a home position under the table top. There are one or more UV generating lamp devices, e.g., a pair of UV fluorescent tubes 46 mounted on the lower side of the support plate 44 to generate sanitizing UV radiation. Favorably these can be 21-inch to 27-inch tubes, e.g., 24-inch UV tubes, so as to span approximately the width of the central (keyboard) area 34 so as to span the keyboard and mouse. In some cases, a grid of shorter tubes, e.g., 18-inch tubes, can be used to provide adequate UV coverage over the keyboard and mouse.

A curtain or curtains 48 are positioned peripherally on the support plate 44 and hang from the edges of the support plate. These may be in the form of rigid slats (i.e., sheet metal) or fabric drapes, or may be constructed partly of each, such as rigid slats above and the bottom portion being an opaque drape. The object of the curtain is to contain the UV radiation so that it irradiates the keyboard 30 and mouse 32 within the central area 34, but prevents stray UV light from radiating elsewhere in the radiology room.

The hood 40 is of the same dimension and profile of the central area 34, so that when the hood 40 is pulled out, the hood is positioned over that area 34 and bathes the keyboard 30 and mouse device 32 with sterilizing radiation. As shown in FIGS. 1 and 2, the hood is normally positioned in a retracted home or distal position beneath the rear table top 14, but can be pulled out to a proximal, extended position over the central area 34 of the front table top 12, so that the keyboard and mouse can be irradiated and sterilized after a radiology work session.

As shown in FIG. 2, an interlock mechanism is provided so that the hood 40 can be turned on to generate UV radiation only when it has been pulled out away from its home position, and so that when the hood has been pulled out, the motorized pedestal mechanisms are disabled and cannot change the vertical position of either the front table top 12 or the rear table top 14.

A hood position sensor 50, shown schematically in FIG. 2, is coupled to a lamp enable/disable circuit 52 so that the lamps or UV tubes 46 can be energized only when the hood 40 is pulled out to the extended position over the keyboard and mouse area 34. The position sensor 50 is also coupled to a table enable/disable circuit 54, which ensures that the motorized pedestals 18, 20 can only be energized when the hood 40 is fully pushed in to its retracted or home position.

Figure 3:
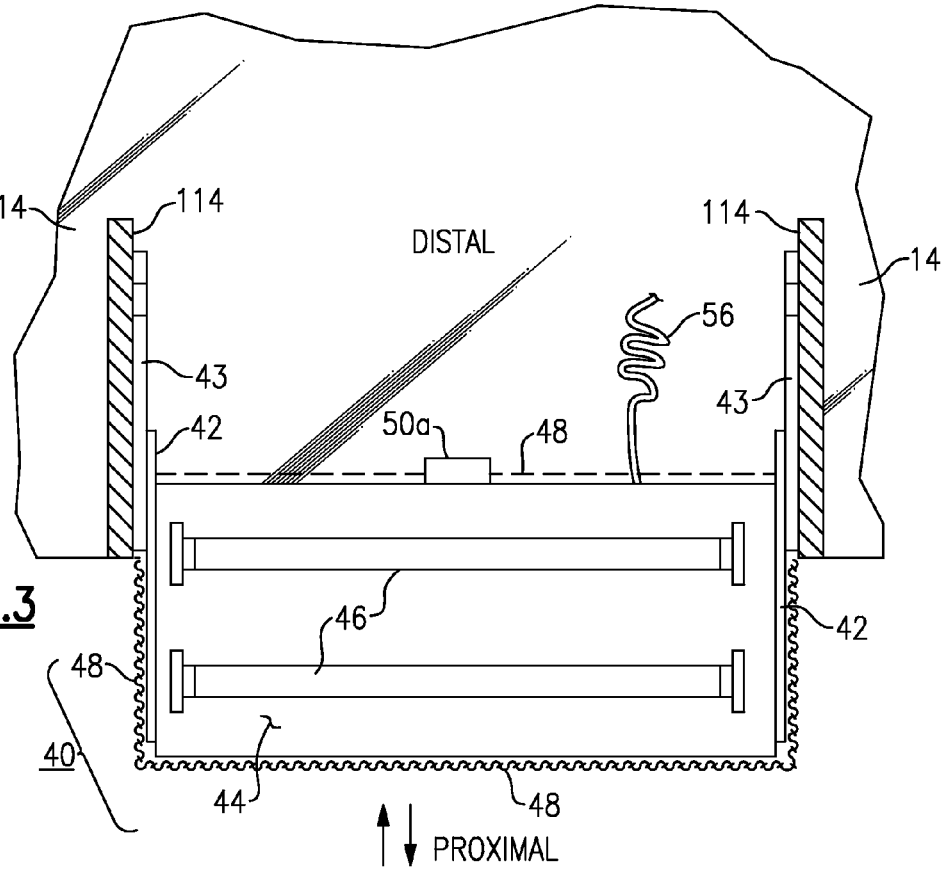
FIG. 3 is a lower view of the sanitizer hood of this embodiment

Some detail of the UV keyboard sterilizer hood 40 is shown in FIG. 3, where the hood 40 is viewed from underneath. Here are shown the slides 42 which are attached to the under side of the rear table top 14. There are rollers (which roll within the slides 42) mounted on the upper side of the upper support plate 44, and those rollers are obscured in this view. There are a pair of twenty-four inch UV fluorescent tubes 46 mounted transversely on the under side of the support plate 44, and the drape or curtain 48 is shown along the periphery of the support plate 44.

A proximity switch 50*a*, which is a component of the hood position sensor 50, is shown here mounted at a distal or back edge of the hood 40, and there is a coiled electrical cable 56 at the back edge of the hood, to connect with other components of the work station. Some components, such as the UV ballast, would be understood to be present, and are not specifically illustrated here. In simplest form, the switch 50*a* may be a single, momentary-contact switch to turn the gear motors off and turn the UV lamp(s) on when the hood 40 is pulled forward.

The proximity switch 50*a* may be optical, magnetic, mechanical proximity sensor. The circuit for energizing the UV lamp(s) 46 may incorporate a timer or time delay, e.g., so that there is a delay of a few minutes after the radiology work station before the sanitizing radiation is emitter and/or so that the emission of radiation is terminated after some predetermined time, e.g., fifteen minutes. Also, an audible sounder may be incorporated to alert the user that the UV sanitizing procedure is about to begin, or to indicate that the procedure has been completed.

In some preferred embodiments, the computer 28 may keep track of the times and completions of the sanitization procedures.

In this embodiment, the slide 42 is adapted for one-dimensional motion only, i.e., the hood can only be pulled out and pushed back, and remains at the same level in its retracted and extended positions. However, in other possible embodiments, it may be possible to lower the hood when in the extended position, so that the drapes or curtains 48 contact the upper surface of the front table top 12.

The hood 40 may be provided as a separate, add-on assembly to convert or retrofit an existing radiology work station. In that case, the sanitizing hood 40 with slides and the required sensors and switches can be included in a kit, and may be installed in the field.

While the invention has been described hereinabove with reference to a selected preferred embodiment, it should be recognized that the invention is not limited to that precise embodiment. Rather, many modification and variations would present themselves to persons skilled in the art without departing from the scope and spirit of this invention, as defined in the appended claims.

I claim:

1. An ergonomic filmless radiology work station at which a radiologist can study medical images that have been captured in digital form and displayed on one or more monitors, comprising:

a base adapted to rest upon a floor;

at least one pedestal arrangement extending vertically upward from the base;

a front work platform adjustably supported from said at least one pedestal arrangement, the platform having a central area on an upper surface thereof adapted for placement of one or more interface control devices to be manipulated by the radiologist;

a rear work platform situated rearward of and elevated in respect to said front work platform, and adjustably supported from said at least one pedestal arrangement, said rear work platform being adapted to support one or more monitors for display of said medical images;

motorized height adjustment means operatively coupled to said front work platform and said rear work platform for controllably positioning said work platforms respectively at desired heights above said base;

control means coupled to said motorized height adjustment means, and actuable by said radiologist, permitting the radiologist to control the motorized height adjustment means for moving each of said front work platform and said rear work platform upward and downward;

a keyboard sanitizer device mounted at an underside of said rear work platform, including a slide mounted on said rear work platform; an upper support portion mounted on said slide and adapted to be pulled forward to an extended position and pushed in to a retracted position beneath the rear work platform; at least one UV generator lamp positioned on said upper support portion; and a curtain surrounding said support portion and depending downward therefrom to contain radiation of said at least on UV generator lamp; such that when said keyboard sanitizer device is pulled out it is positioned over said central area, and when the at least one UV lamp is energized the at least one UV generating lamp irradiates the central area with sanitizing UV radiation; and electrical interlock means operatively coupled to said keyboard sanitizer device and to said motorized height adjustment means such that when said keyboard sanitizer device is pulled out to the extended position, the interlock means disables said motorized height adjustment means so that the height of the front and rear work platforms cannot be adjusted; and when said keyboard sanitizer device is pushed in to its retracted position said interlock means disables said keyboard sanitizer device so that the at least one UV generator lamp is prevented from generating said UV radiation.

2. The ergonomic filmless radiology work station according to claim 1, wherein said at least one pedestal arrangement includes left and right support posts supporting said rear work platform, and said motorized height adjustment means includes a pair of motor drives associated with the left and right support posts, respectively.

3. The ergonomic filmless radiology work station according to claim 2, wherein said at least one pedestal arrangement includes left-front and right-front support posts supporting said front work platform, and said motorized height adjustment means includes a pair of motor drives associated with the left-front and right-front support posts, respectively.

4. The ergonomic filmless radiology work station according to claim 1, wherein said curtain means of said keyboard sanitizer device includes rigid shades disposed at least on front, left and right sides of said upper support platform thereof.

5. The ergonomic filmless radiology work station according to claim 1, wherein said curtain means of said keyboard sanitizer device includes a fabric curtain disposed at least on a front side of said upper support platform thereof.

6. The ergonomic filmless radiology work station according to claim 1, wherein said curtain means of said keyboard sanitizer device is in the form of fabric drapes opaque to said UV radiation.

7. The ergonomic filmless radiology work station according to claim 1, wherein said at least one UV generator lamp includes a UV fluorescent tube.

8. The ergonomic filmless radiology work station according to claim 7, wherein said at least one UV generator lamp includes a pair of UV fluorescent tubes.

9. The ergonomic filmless radiology work station according to claim 8, wherein said pair of UV fluorescent tubes are twenty-one to twenty-seven inch tubes and are disposed transversely on said upper support platform.

10. The ergonomic filmless radiology work station according to claim 1, wherein said electrical interlock means includes a presence switch disposed at the back of said keyboard sanitizer device and providing an indication of one sense when the keyboard sanitary device is disposed in its retracted position and providing an indication of an opposite sense when the keyboard sanitizer device is pulled out to its extended position.

11. A keyboard sanitizer arrangement adapted to be mounted at an underside of a rear work platform of an ergonomic filmless radiology work station at which work station a radiologist can study medical images that have been captured in digital form and displayed on one or more monitors, in which the work station is comprised of:

a base adapted to rest upon a floor;

at least one pedestal arrangement extending vertically upward from the base;

a front work platform adjustably supported from said at least one pedestal arrangement, the platform having a central area on an upper surface thereof adapted for placement of one or more interface control devices to be manipulated by the radiologist;

said rear work platform being situated rearward of and elevated in respect to said front work platform, and adjustably supported from said at least one pedestal arrangement, said rear work platform being adapted to support one or more monitors for display of said medical images;

motorized height adjustment means operatively coupled to said front work platform and said rear work platform for controllably positioning said work platforms respectively at desired heights above said base; and control means coupled to said motorized height adjustment means, and actuable by said radiologist, permitting the radiologist to control the motorized height adjustment means for moving each of said front work platform and said rear work platform upward and downward;

and wherein said keyboard sanitizer arrangement comprises:

a keyboard sanitizer device including a slide adapted to be mounted onto an underside of said rear work platform; an upper support portion mounted on said slide and adapted to be pulled forward to an extended position and pushed in to a retracted position beneath the rear work platform; at least one UV generator lamp positioned on said upper support portion; and a curtain surrounding said support portion and depending downward therefrom to contain radiation of said at least on UV generator lamp; such that when said keyboard sanitizer device is pulled out it is positioned over said central area of the front work platform, and when the at least one UV lamp is energized the at least one UV generating lamp irradiates the central area with sanitizing UV radiation; and electrical interlock means operatively coupled to said keyboard sanitizer device and adapted to be coupled to said motorized height adjustment means such that when said keyboard sanitizer device is pulled out to the extended position, the interlock means disables said motorized height adjustment means so that the height of the front and rear work platforms cannot be adjusted; and when said keyboard sanitizer device is pushed in to its retracted position said interlock means disables said keyboard sanitizer device so that the at least one UV generator lamp is prevented from generating said UV radiation.

12. The keyboard sanitizer arrangement according to claim 11, wherein said curtain means includes rigid shades disposed at least on front, left and right sides of said upper support platform.

13. The keyboard sanitizer arrangement according to claim 11, wherein said curtain means includes a fabric curtain disposed at least on a front side of said upper support platform.

14. The keyboard sanitizer arrangement according to claim 11, wherein said curtain means is in the form of fabric drapes opaque to said UV radiation.

15. The keyboard sanitizer arrangement according to claim 11, wherein said at least one UV generator lamp includes a UV fluorescent tube.

16. The keyboard sanitizer arrangement according to claim 15, wherein said at least one UV generator lamp includes a pair of UV fluorescent tubes.

17. The keyboard sanitizer arrangement according to claim 16, wherein said pair of UV fluorescent tubes are twenty-one to twenty-seven inch tubes and are disposed transversely on said upper support platform.

18. The keyboard sanitizer arrangement according to claim 11, wherein said electrical interlock means includes a presence switch disposed at the back of said keyboard sanitizer device and providing an indication of one sense when the keyboard sanitary device is disposed in its retracted position and providing an indication of an opposite sense when the keyboard sanitizer device is pulled out to its extended position.

* * * * *